US009907995B1

(12) United States Patent
Miller

(10) Patent No.: US 9,907,995 B1
(45) Date of Patent: Mar. 6, 2018

(54) SUSPENSION ELLIPTICAL EXERCISE DEVICE

(71) Applicant: Larry D. Miller Trust, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 15/698,295

(22) Filed: Sep. 7, 2017

Related U.S. Application Data

(60) Provisional application No. 62/529,142, filed on Jul. 6, 2017.

(51) Int. Cl.
*A63B 22/04* (2006.01)
*A63B 22/06* (2006.01)

(52) U.S. Cl.
CPC ... *A63B 22/0605* (2013.01); *A63B 2022/0611* (2013.01)

(58) Field of Classification Search
None
See application file for complete search history.

(56) References Cited

U.S. PATENT DOCUMENTS 5,518,473 A 5/1996 Miller
5,611,756 A 3/1997 Miller
6,045,487 A 4/2000 Miller
7,556,591 B2 7/2009 Chuang et al.
7,678,025 B2 * 3/2010 Rodgers, Jr. ..... A63B 21/151 482/52
7,708,668 B2 5/2010 Rodgers, Jr.
7,878,947 B1 2/2011 Rodgers, Jr.
8,303,470 B2 * 11/2012 Stewart ..... A63B 22/001 482/51
8,979,714 B2 3/2015 Miller
9,192,809 B1 * 11/2015 Miller ..... A63B 21/154
9,522,300 B1 * 12/2016 Miller ..... A63B 22/0664
2014/0296036 A1 * 10/2014 Miller ..... A63B 22/001 482/52

* cited by examiner

*Primary Examiner* — Stephen R Crow
(74) *Attorney, Agent, or Firm* — Dinsmore & Shohl LLP

(57) ABSTRACT

An exercise device has guide links each having a first attachment point pivotally attached to an upper part of a frame. Foot support links each have a foot receiving area to support a user's foot and are pivotally connected to a second attachment point of one of the guide links so that when the guide links pivot relative to the frame, the foot support links move in a path of travel having a horizontal component of motion. A first and a second control pulley are each pivotally connected to a respective one of the guide links and offset from the first pivot axis so as to move in an arc. A first and a second flexible element each couple the vertical drive assembly to a respective one of the foot support links. Each flexible element has a midportion extending about a respective one of the control pulleys.

25 Claims, 8 Drawing Sheets

SUSPENSION ELLIPTICAL EXERCISE DEVICE

REFERENCE TO RELATED APPLICATION

This application claims priority to U.S. Provisional Patent Application Ser. No. 62/529,142, filed Jul. 6, 2017, the entire content of which is incorporated herein by reference.

FIELD OF THE INVENTION

This invention relates generally to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links is pivotally supported on a frame and a foot engaging link is supported at the lower end of each guide link. An intermediate link connects each guide link to A crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers. Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

U.S. Pat. No. 8,979,714 to Miller discloses an elliptical exercise device having a frame supporting guide links which provide for horizontal motion of associated foot support links. A mechanical coupling couples the foot support links to the crank system and intermediate links connect the crank system to the guide links such that a foot receiving area of each foot support link moves in an elliptical path when the crank system rotates.

U.S. Pat. No. 9,192,809 to Miller et al. discloses an elliptical exercise device with a frame supporting guide links and foot support links. Upper pulleys are pivotally connected to the frame or guide links, front lower pulleys are connected to the guide links or foot support links and rear lower pulleys are connected to the foot support links. A flexible element extends from a vertical drive assembly to the upper pulley, front lower pulley, rear lower pulley and then to the frame rearward of the guide link pivot.

Additional exercise devices will be known to those of skill in the art.

SUMMARY OF THE INVENTION

The present invention offers several embodiments of an elliptical exercise device. Some embodiments offer a path of motion with desirable characteristics.

One embodiment of an exercise device has a frame configured to be supported on a horizontal surface, the frame having a first pivot axis defined thereon. A first and a second guide link each have a first and a second attachment point defined thereon, with each guide link being pivotally attached, through its first attachment point, to the frame at the first pivot axis thereof. Each of the guide links has a guide length defined between the respective first and second attachment points. A first and a second foot support link each has a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. Each of the foot support links has a coupling point defined thereon. A first and a second control pulley are each pivotally connected to a respective one of the guide links at a distance offset from the first pivot axis such that the control pulleys each move in an arc as the corresponding guide link pivots. The offset distance is defined as a control distance. The control distance is less than or equal to 50% of the guide length. A vertical drive assembly is supported on the frame. A first and a second flexible element each coupling the vertical drive assembly to the coupling point of a respective one of the foot support links, each flexible element having a midportion extending from the coupling point of the respective foot support link to and about a respective one of the control pulleys. The vertical drive assembly is operable via the flexible elements to move the foot receiving areas of the foot support links in a path of travel having a vertical component of motion.

An embodiment of an exercise device has a frame configured to be supported on a horizontal surface, the frame having an upper portion with a first pivot axis defined thereon. A first and a second guide link each has a first and a second attachment point defined thereon, each guide link being pivotally attached, through its first attachment point, to the frame at the first pivot axis thereof. A first and a second foot support link each has a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. Each of the foot support links has a coupling point defined thereon. A first and a second control pulley are each pivotally connected to a respective one of the guide links at a distance offset from the first pivot axis such that the control pulleys each move in an arc as the corresponding guide link pivots. A vertical drive assembly is supported on the frame. A first and a second flexible element each couple the vertical drive assembly to the coupling point of a respective one of the foot support links. Each flexible element has a midportion extending directly from the coupling point of the respective foot support link to and about a respective one of the control pulleys. The vertical drive assembly is operable via the flexible elements to move the foot receiving areas of the foot support links in a path of travel having a vertical component of motion.

Yet another embodiment of an exercise device has a frame configured to be supported on a horizontal surface, the frame having an upper portion with a first pivot axis defined thereon. A first and a second guide link each has a first and a second attachment point defined thereon, each guide link being pivotally attached, through its first attachment point, to the frame at the first pivot axis thereof. A first and a second foot support link each has a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. Each of the foot support links has a coupling point defined thereon. A first and a second control pulley are each pivotally connected to a respective one of the guide links at a distance offset from the first pivot axis such that the control pulleys each move in an arc as the corresponding guide link pivots. A vertical drive assembly is supported on the frame. A first and a second flexible element each couple the vertical drive assembly to the coupling point of a respective one of the foot support links. Each flexible element has a midportion extending from the coupling point of the respective foot support link to and about a respective one of the control pulleys. A control portion of each flexible element is defined from the coupling point to the corresponding control pulley. Each control pulley is positioned relative to the first attachment point of the corresponding guide link such that as the second attachment portion of the guide links swing forwardly, the corresponding control portion of the respective flexible element is shortened. The vertical drive assembly is operable via the flexible elements to move the foot receiving areas of the foot support links in a path of travel having a vertical component of motion.

Further embodiments are also taught, and variations to any embodiment may be made within the teaching of this disclosure. The following options and versions may apply to one or more of the above-discussed embodiments.

In some versions, the guide link has a forwardly extending control portion, and each control pulley is supported on the respective control portion. Each control pulley may be supported on the connection portion of the corresponding guide link at an axis coaxial with an attachment of the respective horizontal drive link.

In some versions, the flexible element extends generally linearly from the control pulley to an end of the flexible element connected to the vertical drive assembly.

In some versions, each control pulley is disposed below the first pivot axis and forward of the first pivot axis when the respective guide link is disposed generally vertically.

Some versions further include a first and a second frame-mounted pulley disposed on the frame, and each flexible element extends about a respective one of the frame-mounted pulleys between the respective control pulley and vertical drive assembly. The frame-mounted pulleys may be disposed lower than the control pulleys. Each frame-mounted pulley may be disposed generally directly below the corresponding control pulley when the corresponding guide link is disposed generally vertically.

Some versions further include a horizontal drive assembly and a first and a second horizontal drive link each having a first end coupled to the horizontal drive assembly and a second end connected to the corresponding guide link such that the horizontal drive assembly causes the guide links to pivot about the first pivot axis and to thereby cause the foot receiving areas to move in the path of travel having the horizontal component of motion. In some versions, the horizontal drive links each extend generally rearwardly from the horizontal drive assembly to the respective guide link. Each guide link may have a forwardly extending connection portion, with each of the horizontal drive links extending generally vertically from the horizontal drive assembly to a respective one of the connection portions. In certain embodiments, the device also has a crank system and the crank system defines both the horizontal drive assembly and the vertical drive assembly. The crank system has a crank axis and a pair of crank connections offset from and rotatable about the crank axis, and each of the flexible elements has an end connected to one of the crank connections of the crank system such that the ends each travel in a circular path. The first ends of the horizontal drive links are connected to the crank system such that rotation of the crank system causes the foot receiving areas to move both in the path of travel having the horizontal component of motion and in the path of travel having the vertical component of motion. The horizontal component of motion and the vertical component of motion for each foot receiving area are generally out of phase such that the foot receiving areas move in a generally elliptical path. The horizontal drive links may be connected to the crank system at locations that are rotationally offset from the crank connections.

In some versions, the flexible elements each have second ends directly connected to the respective foot support link.

Some versions further include a lower pulley connected to each of the foot support links, and each of the flexible elements has a first end, an opposed second end, and a midportion between the first and second ends, the second end of each of the flexible elements being connected to the upper portion of the frame, the midportion of each of the flexible elements extending downwardly from the second end, about the respective lower pulley, and upwardly and about the respective control pulley. Each flexible element may extend generally linearly from the respective control pulley to the first end connected to the vertical drive assembly. Each foot support link may have a forward end that is pivotally connected to the second attachment point of the respective guide link, a rearward end defining the foot receiving area, and a mid portion, the lower pulleys each being connected to the mid portion of the respective foot support link.

In some versions, the vertical drive assembly comprises a crank system, the crank system having a crank axis and a pair of crank connections offset from and rotatable about the crank axis, the flexible elements each having a first end connected to one of the crank connections of the crank system such that the first ends travel in a circular path.

In some versions, the control distance is in the range of 5% to 25% of the guide length.

Certain versions further include a first and a second guide pulley attached to the guide link, the midportion of each flexible element engaging a respective one of the guide pulleys between the respective coupling point and control pulley.

In some versions, a range of the vertical component of travel motion and/or the horizontal component of travel motion are adjustable.

In some versions, each guide link has a forwardly extending control portion, and each control pulley is supported on the respective control portion, and each control portion is adjustable with respect to the respective guide link to alter the path of travel.

In some versions, each flexible element is a cable, a belt or a chain.

In some versions, each guide link further includes a hand grip portion extending upwardly from the first attachment point.

DETAILED DESCRIPTION OF THE INVENTION

Figure 1:
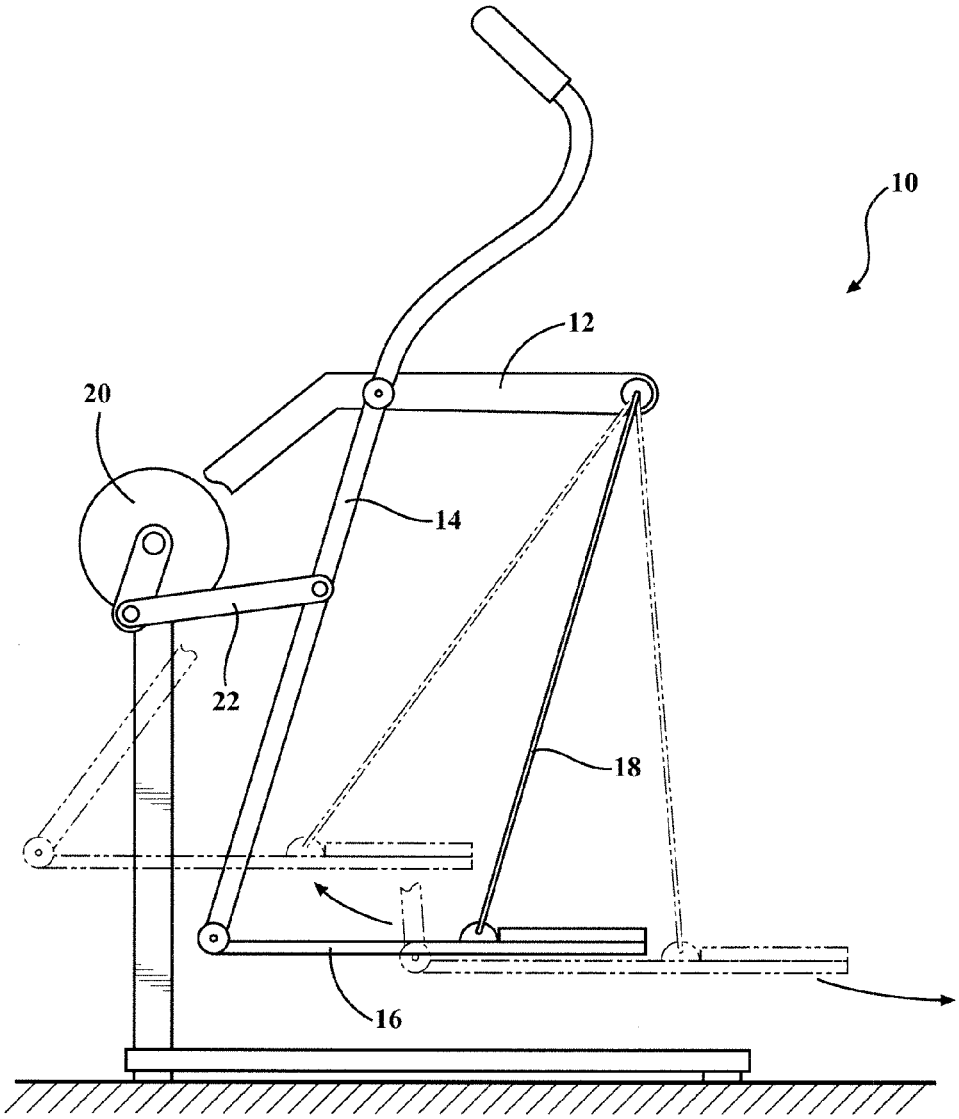
FIG. 1 is a side elevational view of an exercise device to illustrate certain geometric aspects of such a device.

The present invention will be explained with reference to particular embodiments, including optional features of these embodiments. It is to be understood that other embodiments, modifications, and variations thereof will be apparent to those of skill in the art in view of the teaching presented herein.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Certain embodiments of the present invention make use of a crank system to control the horizontal and/or vertical motions of the foot receiving areas of the exercise device.

FIG. 1 shows an example of an exercise device similar to certain prior art designs, in which a parallelogram arrangement is used to control the motion of the foot receiving areas. However, the illustrated device lacks vertical movement and is provided merely to illustrate certain geometric aspects of such a device. The device 10 has a frame 12 with supports the components of the device. It is noted that FIG. 1 is a side elevational view and, while the device has left and right components, only the left side components are visible in this view. Typically a right set of components is also provided and may move out of phase with the left set of components. A guide link 14 is pivotally attached to the frame 12 and extends down to a lower end to which a foot support 16 is pivotally attached. A flexible element 18 has an upper end connected to the frame 12 and a lower end connected to the foot support 16. The flexible element is spaced from the guide link in such a way that the upper and lower pivots on the guide link and the upper and lower ends of the flexible element generally define the corners of a parallelogram. As such, as the guide link pivots on the frame, the foot support 16 moves fore and aft but remains generally level. A crank 20 is shown with a horizontal drive link 22 connecting the crank 20 to the guide link 14 such that rotation of the crank causes the guide link to pivot forwardly and rearwardly. FIG. 1 shows the foot support link in 3 positions. If the upper end of the flexible element is moved forwardly by a significant amount, such as to the guide link pivot or forward thereof, the foot support would not remain level as the guide link pivots. In an actual exercise device, the upper end of the flexible link would extend over a pulley and then to the crank 20 such that the crank can articulate the foot support upwardly and downwardly, thereby leading to an elliptical path of motion.

Figure 2:
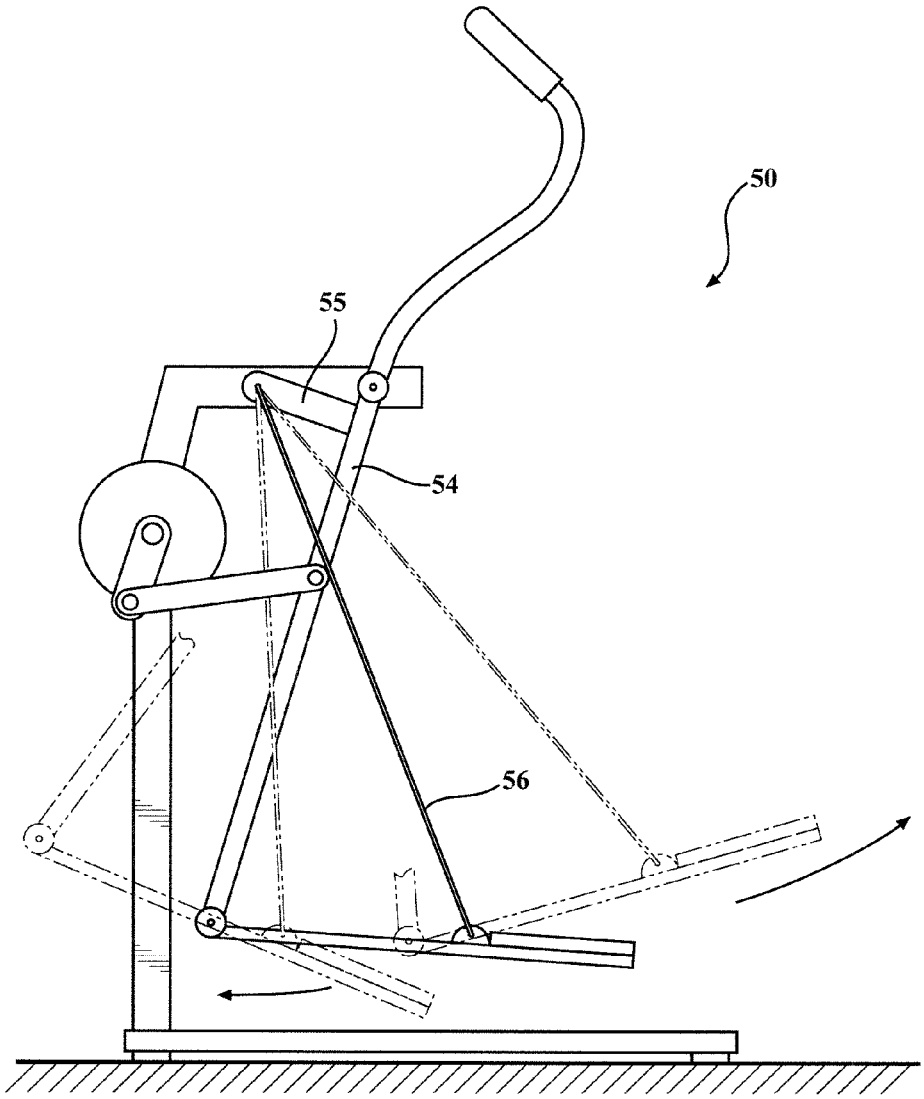
FIG. 2 is a side elevational view of an exercise device with a fixed control cable attached to the guide link to illustrate certain geometric aspects of such a device.

FIG. 2 shows a device 50 similar to the device 10 of FIG. 1 except that the guide link 54 has a forwardly extending portion 55 and the flexible element 56 has a upper end connected to this forwardly extending portion 55. As such, the foot support link is generally fixed relative to the guide link such that an angle between the foot support link and guide link remains constant. Therefore, as the guide link pivots, the foot support link changes angles with respect to the floor. As shown, the foot support link is angled downwardly at the rear of its travel and upwardly at the front. This is undesirable. Applicant is not aware of an exercise device with the configuration of FIG. 2. FIGS. 1 and 2 are included herein to help illustrate how the position of the flexible element impacts the motion profile of the foot support link.

Figure 3:
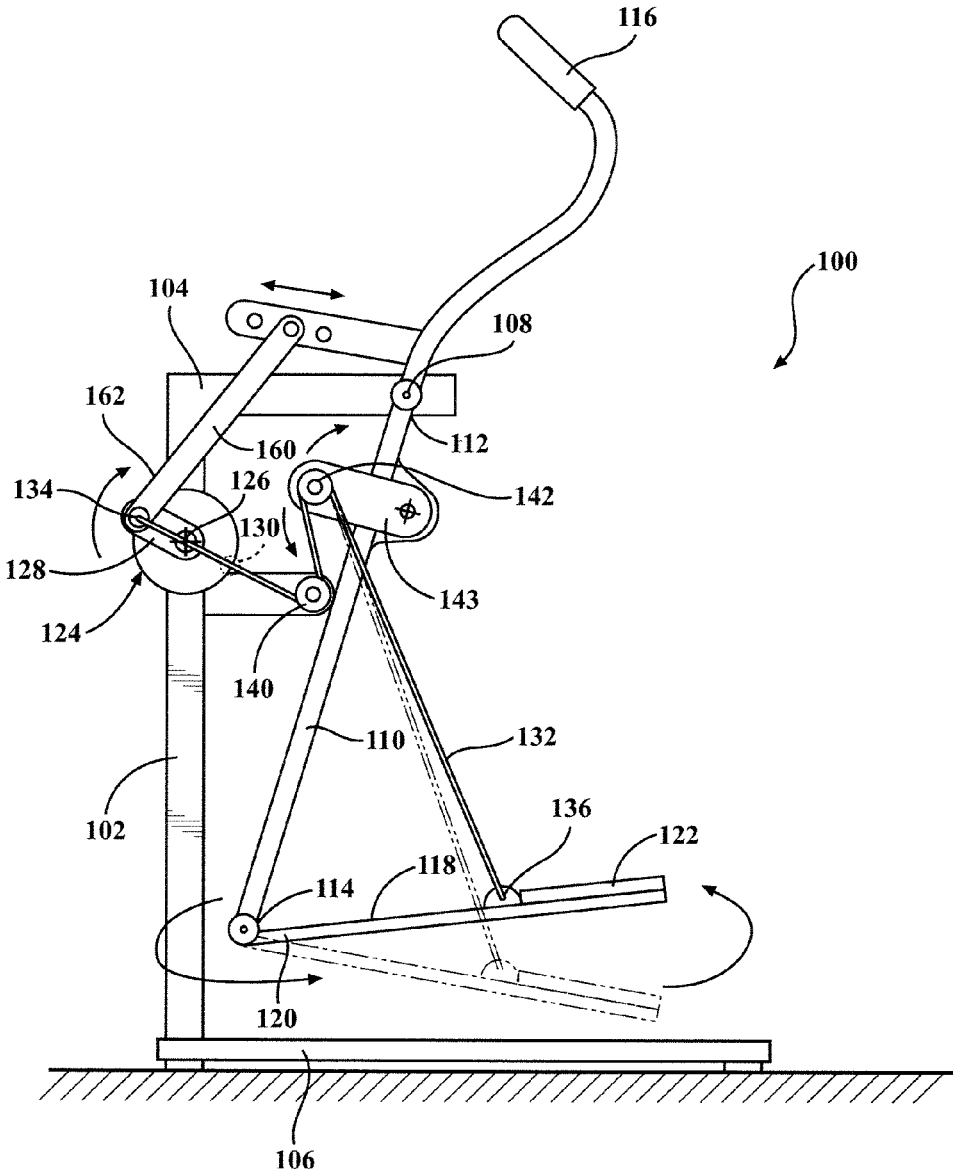
FIG. 3 is a side elevational view of an elliptical exercise device in accordance with an embodiment of the present invention.

Turning now to the present invention, FIG. 3 provides a side view showing the basic layout of a fixed-path version of an elliptical exercise device 100 in accordance with an embodiment of the present invention. The illustrated device 100 includes a frame 102 which is configured and operative to contain and/or support the various other components of the device on a horizontal surface such as a floor. The frame 102 may take a variety of the shapes and forms, as long as it provides support for the components of the device. The frame 102 has an upper portion 104 and a lower portion 106. The lower portion 106 is configured to contact the horizontal surface while the upper portion 104 supports several components of the device. A first pivot axis 108 is defined on the upper portion 104 of the frame 102. The frame 102 may be said to have a forward portion forward of the first pivot axis 108, which is to the left in the view of FIG. 1. In this embodiment, the frame does not have any substantial upper portion rearward of the first pivot axis 108 because it is not necessary to provide a support for a parallelogram linkage. As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 1 shows a side view of the device 100 with the left elements visible.

A pair of guide links are pivotally interconnected with the frame so as to be pivotable about the first pivot axis 108. The left guide link 110 is shown at the midpoint of its travel with the right guide link hidden behind it. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from the first attachment point 112.

Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end.

A crank system 124 is pivotally interconnected with the frame 102 such that a crank system 124 rotates about a second pivot axis 126 defined on the frame 102. The second pivot axis 126 also serves as the crank axis. In this embodiment, the crank system 124 is forward of the first pivot axis 108 and the second pivot axis 126 is below the first pivot axis 108, though it may be positioned elsewhere in other embodiments. The crank system 124 has a pair of crank connections or arms 128 and 130 that are 180 degrees apart. In some embodiment, the crank "arms" are defined by a pulley having connection locations defined thereon. In alternative embodiments, the crank may have actual arms extending from the crank axis. The crank system 124 represents one type of drive assembly, which in this case is a combined vertical drive assembly and horizontal drive assembly. The crank system may include a flywheel, not shown, and any type of resistance device. As known to those of skill in the art, the crank system may be constructed in a variety of ways to allow any links and flexible elements to connect to the crank system and not interfere with each other.

A flexible element 132 couples the vertical drive assembly to the respective foot support link 118. In the illustrated embodiment, the vertical drive assembly is the crank system 124, and rotation of the crank system 124 causes the foot receiving area 122 of the foot support link 118 to move upwardly and downwardly, which is a path of travel having a vertical component of motion. The flexible element 132 may be a cable, belt, chain, or another type of flexible element. One end 134 of the element 132 is connected to a crank arm 128 of the crank system and an opposite end 136 is connected to the foot support link 118 toward the rearward end. The point at which the end 136 is attached to the foot support link may be considered a coupling point, also indicated as 136. As the crank system 124 rotates, the foot receiving areas 122 are moved upwardly and downwardly by the flexible elements. The flexible elements 132 extend over one or more pulleys between the ends 134 and 136. In this embodiment, an intermediate pulley 140 is disposed on the frame 102 rearward of the crank axis 126 and slightly below the crank axis. A control pulley 142 is mounted on the guide link 110 a short distance below the first attachment point 112 and slightly forward. The flexible element 132 extends from the second end 136, at the foot support link 118, upwardly and forwardly, over and around the control pulley 142, under and around the intermediate pulley 140, and to the first end 134.

Figure 4:
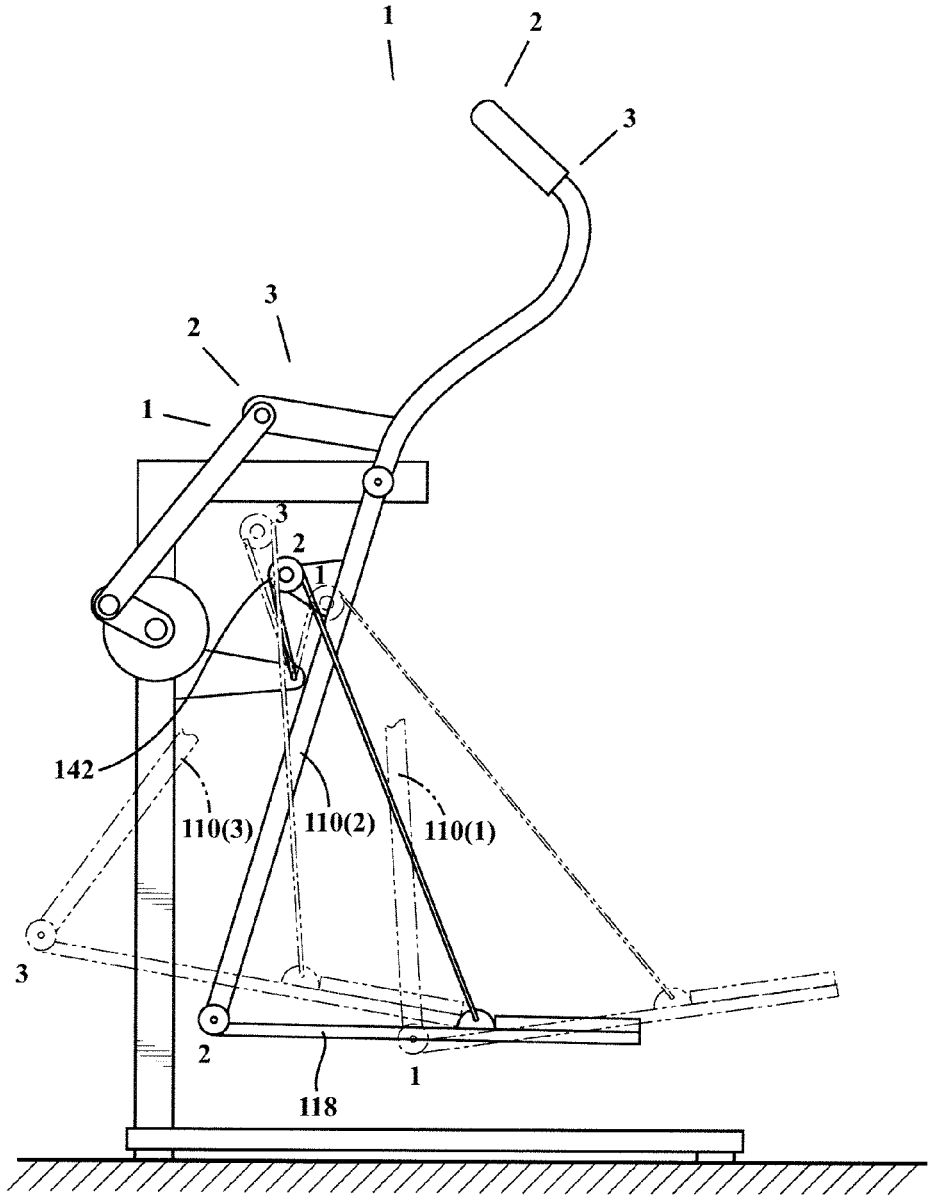
FIG. 4 is a side elevational view of an elliptical exercise device similar to the device of FIG. 3 to illustrate the functional relationship of various components.
Figure 5:
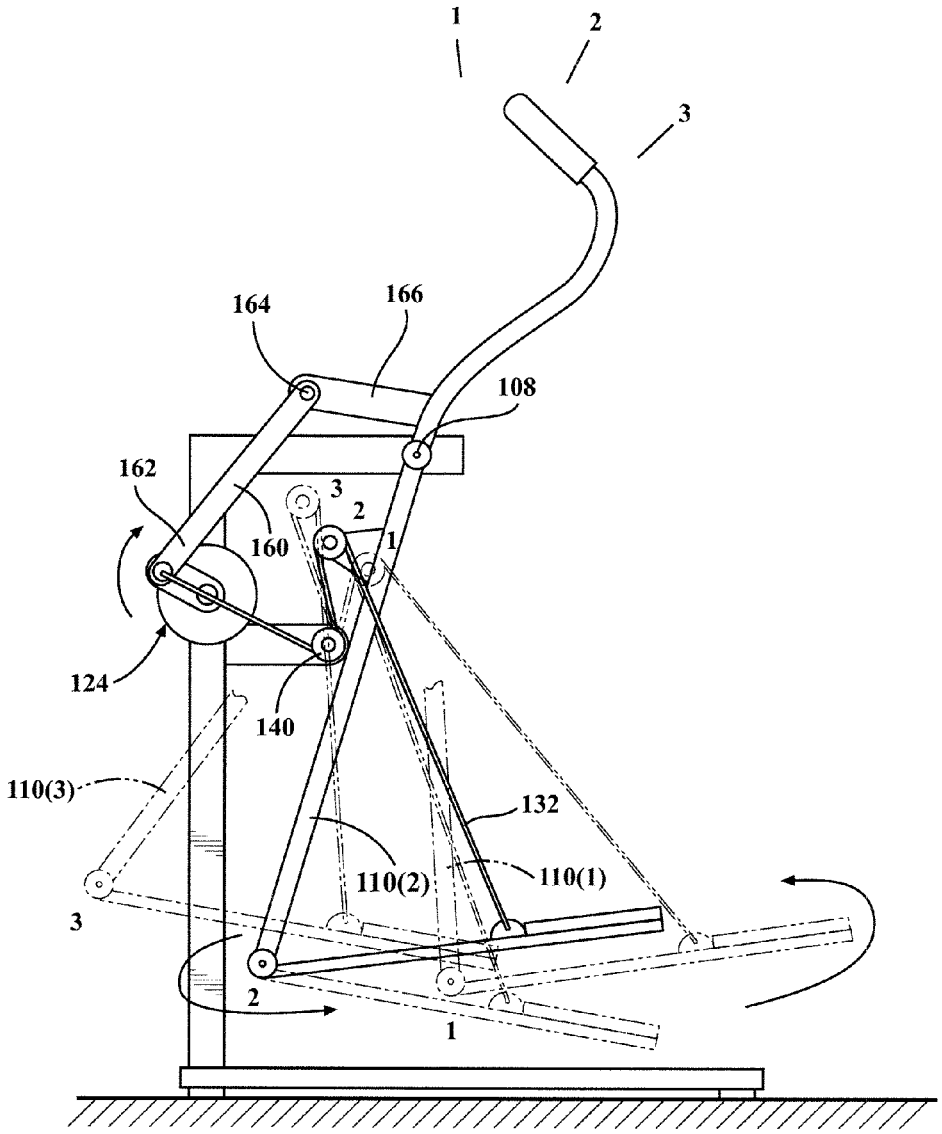
FIG. 5 is a side elevational view of the elliptical exercise device of FIG. 3 showing the components in various positions.

Referring now to FIGS. 4 and 5, the motion characteristics of the device 100 will be explained. FIG. 4 shows a device similar to the device 100 except that the first ends of the flexible element are attached to the frame, rather than being attached to the crank system. Specifically, the flexible elements are connected to the frame at the same position as the intermediate pulley 140 in FIG. 3. This Figure is provided to illustrate certain geometric aspects of the device. Three positions of the guide link 110 are marked as 110(1), 110(2) and 110(3) corresponding to rear, midpoint and forward positions, respectively. Other portions of the Figure are likewise marked as 1, 2 and 3 indicating corresponding positions of the handle, control pulley 142 and other elements. Because the control pulley 142 is mounted to the guide link 110, and the end of the flexible link is attached to the frame, pivoting of the guide link 110 causes the flexible element to be "pulled" up and "released" down. The elements are positioned such that the foot support link 118 remains closer to level as the guide link pivots, as compared to the arrangement in FIG. 2. The movement of the control pulley 142 at least partially compensates for the fact that the flexible element is not in a parallelogram arrangement (i.e. the flexible element extends forwardly rather than being generally parallel to the guide link). The specific motion profile depends on the positions of the control pulley on the guide link and the attachment to the frame, as well as other dimensions. As clear from the drawings, the control pulleys are offset from the guide link pivot axis such that the control pulleys move in an arc as the guide links pivot.

FIG. 5 is similar to FIG. 4 but instead of the end of the flexible element being attached to the frame at the position of the intermediate pulley, an intermediate pulley 140 is provided and the end of the flexible element is attached to the crank system, in the same way as in FIG. 3. FIG. 5 differs from FIG. 3 in that the components of the device in FIG. 5 are shown at the three positions, 1, 2 and 3, as in. FIG. 4. By attaching the end of the flexible element to the crank system, rotation of the crank system articulates the flexible element by an additional amount causing generally vertical movement of the foot receiving areas. By coordinating this motion with horizontal motion, a generally elliptical foot path may be achieved.

Referring to FIGS. 3 and 5, the illustrated embodiment of the exercise device 100 is a fixed path device with a horizontal drive assembly driving the guide links such that the foot receiving areas move in a path of travel having a horizontal component of motion. In this embodiment, the horizontal drive assembly is part of the crank system 124. Specifically, the crank system is also a crank forming the horizontal drive assembly. A horizontal drive link 160 has a lower 162 end connected to the crank system 124 and an upper end 164 connected to an attachment portion 166 extending forwardly from the guide link 110. As such, as the crank system 124 rotates about the crank axis 126, the horizontal drive link 160 causes the guide link 110 to pivot about the first pivot axis 108. A second horizontal drive link (not shown) controls the other guide link and is attached to the crank system at a position 180 degrees from the first horizontal drive link 160. As shown, in this embodiment, the connection of each horizontal drive link is the same as the connection of the respective flexible element (only element 132 is shown). That is, the horizontal drive link 160 for controlling horizontal motion of the left foot is connected to the crank at the same location as the flexible element 132 for controlling vertical motion of the left foot. In some embodiments, the connection locations may be different so as to provide a desirable footpath.

To adjust the range of horizontal travel, the attachment points on attachment portion 166 may be adjustable, either manually or by an actuator so as to change where the horizontal drive link 160 attaches. One example is illustrated in FIG. 3. FIG. 3 also illustrates that the position of the control pulley 142 relative to the guide link may be adjustable, such as by disposing the pulley on a link 143 that pivots on the guide link. By pivoting the link 143, the position of the corresponding foot support link is changed so as to alter its angular position. The range of vertical travel may also be adjusted in various ways.

The present invention may also provide a free stride elliptical exercise device. In this version, the horizontal drive links are omitted and the guide links may be interconnected by a coordination mechanism that maintains them at 180 degrees out of phase. Those of skill in the art will be aware of coordination mechanisms for use with such an exercise device.

Figure 6:
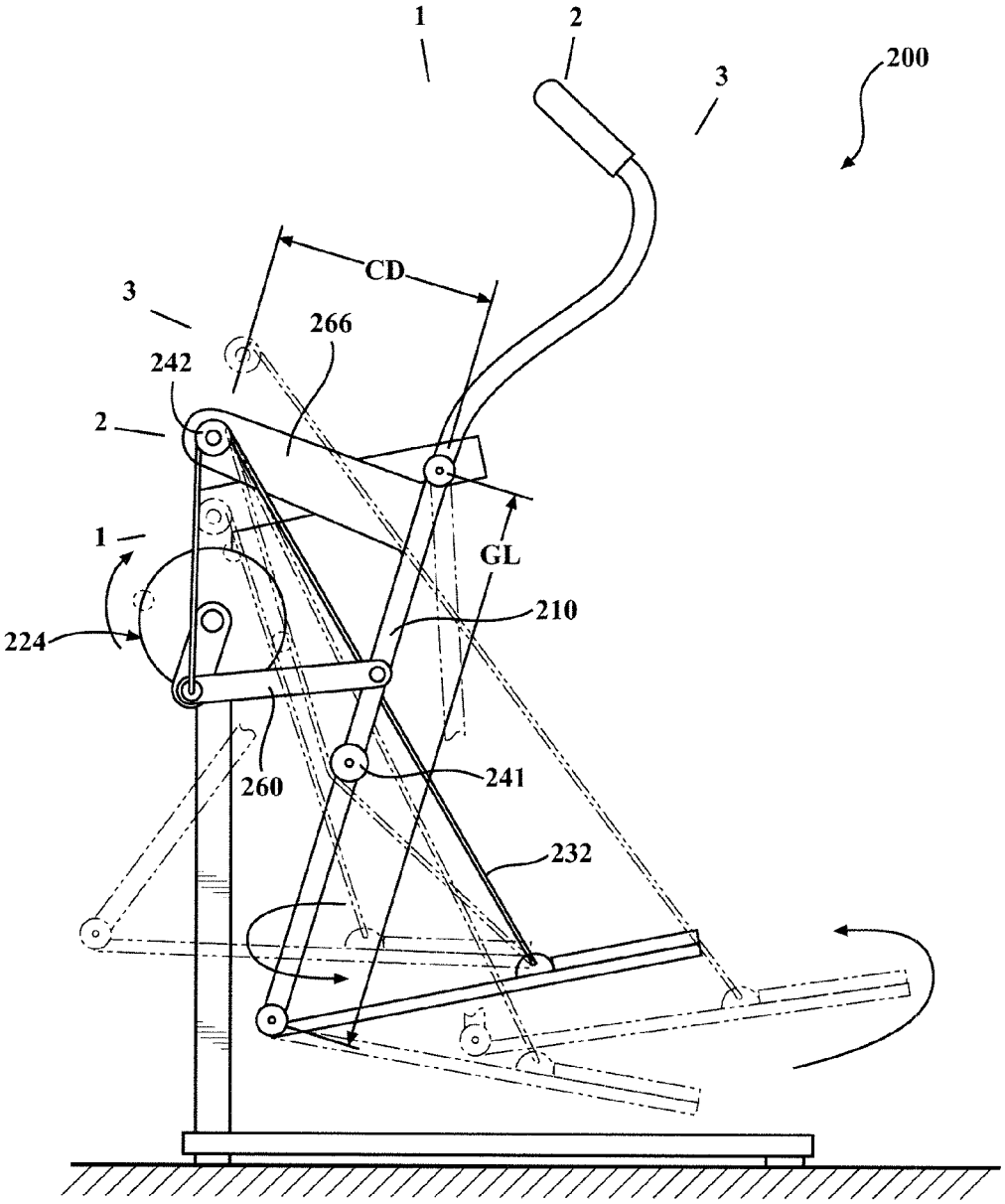
FIG. 6 is a side elevational view of an alternative embodiment of an elliptical exercise device in accordance with the present invention.

FIG. 6 shows an alternative embodiment of an elliptical exercise device 200. The device is in many ways similar to the device 100. The key differences will be described. A control pulley 242 is again provided but it is positioned higher and farther forward than in the device 100, and no intermediate pulley is provided. The control pulley 242 is supported on a control portion 266 that extends forwardly from the guide link 210. The flexible element 232 extends from the foot support link 218 over the control pulley 242 and then directly and linearly to the crank system 242, which serves as the vertical drive assembly. The motion profile is similar, and again depends on the specific positions of the components. The distance between the first and second attachment points of the guide links, for any embodiment, may define a "guide length" and is labeled as GL in FIG. 6. The offset distance of the control pulley 242 from the first axis, where the guide link attaches to the frame, may define a "control distance" and is labeled as CD in FIG. 6. These definitions may apply to any of the embodiments. As will be clear to those of skill in the art, the greater the control distance, CD, the greater the impact of the control pulley on the motion of the foot receiving areas. In some embodiments of the present invention, the control distance CD is no more than 50% of the guide length GL. In further embodiments, the CD is at least 5% of GL. In other embodiments, the CD is in the range of 5% to 25% of GL.

FIG. 6 also illustrates an alternative design wherein a guide pulley 241 is provided on the guide link 210 and the flexible element engages the guide pulley between the coupling point on the foot support link and the control pulley 242. Such a guide pulley may be provided in any embodiment and may engage the flexible element at all times or at only certain positions of travel. The guide pulley may be positioned differently than shown.

FIG. 6 illustrates the various components in a plurality of positions. Another distinction as compared to the device 100 is that the horizontal drive link 260 extends rearwardly to connect to the guide link 210 and the horizontal drive link is connected to a location on the crank system that is rotationally offset from the crank arm for the corresponding flexible element 232. The rotational offset may be approximately 90 degrees. The specific features of the device 100 and device 200 may be combined in other ways.

Figure 7:
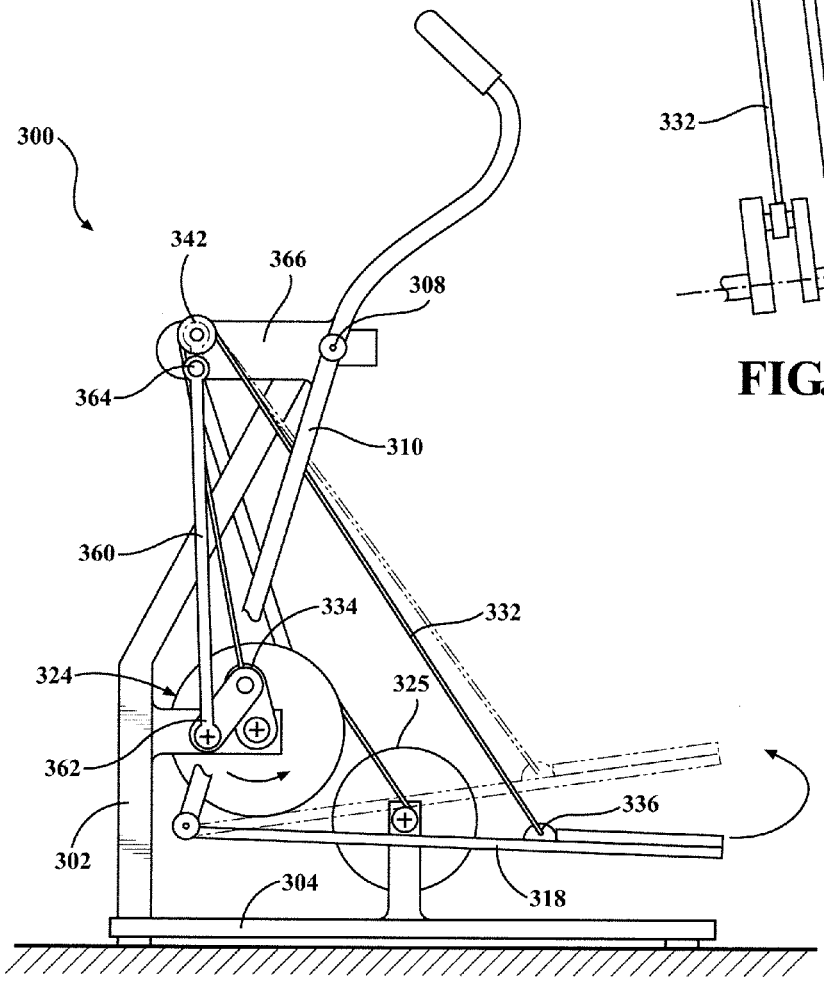
FIG. 7 is a side elevational view of another alternative embodiment of an elliptical exercise device in accordance with the present invention.
Figure 8:
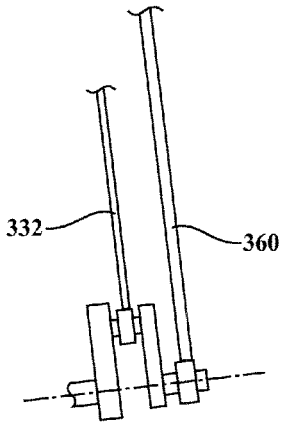
FIG. 8 is a detailed view of a portion of a crank system that forms part of the embodiment of FIG. 7.

Referring now to FIGS. 7 and 8, an elliptical exercise device according to another alternative embodiment of present invention will be described. The exercise device 300 is similar to the device 200 but differs in a variety of ways. First, the crank system 324 is disposed near the lower portion 304 of the frame 302. A flywheel or resistance device is shown at 325 and is connected to the remainder of the crank system by a belt. The guide link 310 has a forwardly extending control portion 366 and the control pulley 342 is supported by the control portion 366. In this version, the control portion extends forwardly from the guide link at the location of the first axis 308.

The flexible element 332 has one end 336 connected to the foot support link 318. It extends upwardly and forwardly to the control pulley 342 and then downwardly directly and generally linearly to another end 334 connected to the crank system 324.

The horizontal drive assembly is also defined by the crank system 324. The horizontal drive link 360 has a lower end 362 connected to the crank system and an upper end 364 connected to the control portion 366 at a location near the control pulley 342. The lower end 362 of the horizontal drive link 360 is connected to the crank system at a location that is rotationally offset from the connection of the flexible element 332.

FIG. 7 also shows an alternative, in phantom lines, wherein the upper end 364 of the horizontal drive link 360 is attached at the axis of the control pulley 342. This approach may be preferred for some devices.

FIG. 8 shows a view of a portion of the crank system illustrating how a crankshaft-like structure may be used to connect the horizontal drive link 360 and the flexible element 332 to the crank system. Other approaches may also be used.

Figure 9:
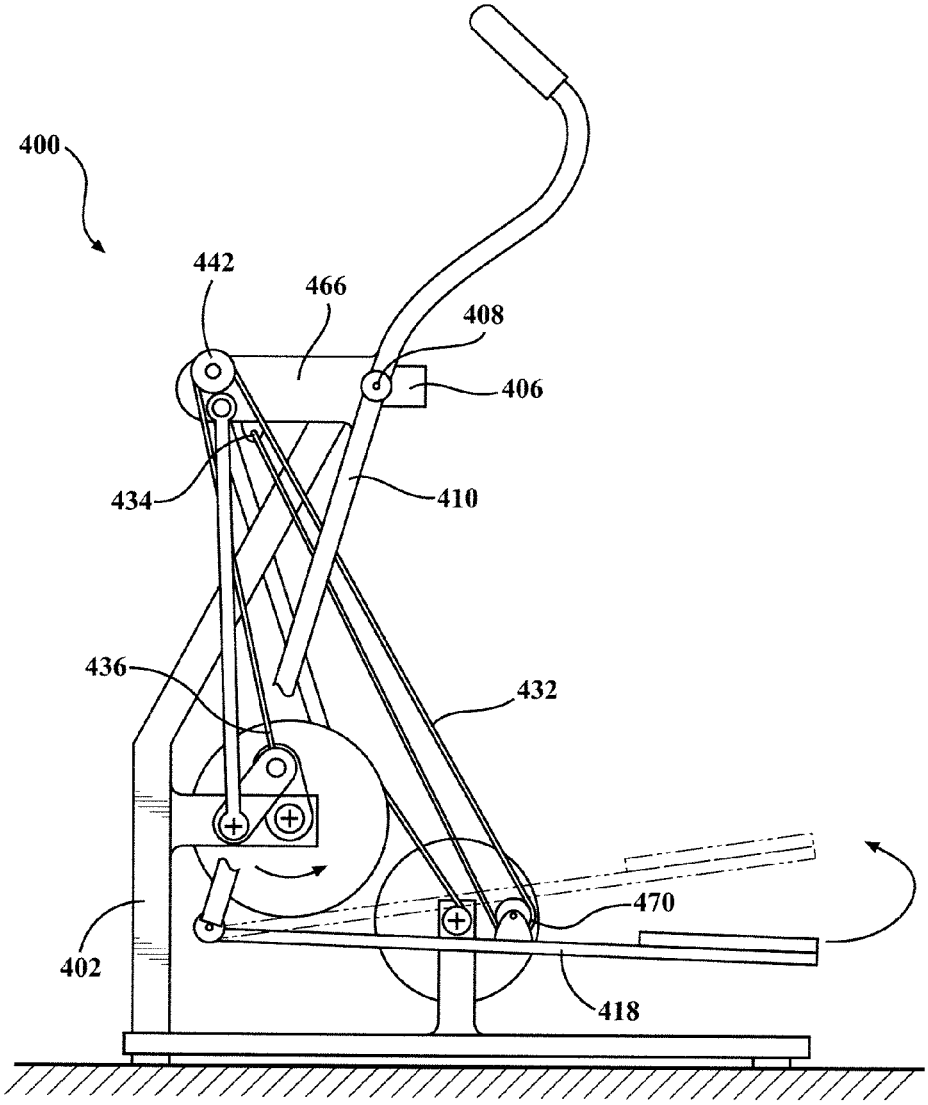
FIG. 9 is a side elevational view of yet another alternative embodiment of an elliptical exercise device in accordance with the present invention.

FIG. 9 illustrates an elliptical exercise device 400 according to yet another alternative embodiment of present invention. The device 400 is similar to the device 300 and only key differences will be described. The flexible element 432 is still coupled to the foot support link 418 but it is coupled by a lower pulley 470, which defines the coupling point of the foot support link 418. Specifically, the flexible element 432 may be said to have a first end first end 434 and a second end 436. A midportion extends between the ends. The first end is coupled to the vertical drive assembly, provided by the crank system 424. The second end is attached to the upper portion 406 of the frame 402. The upper portion 406 where the second end attaches is mostly hidden behind the control portion 466 of the guide link 410. Alternatively, the second end 436 may be connected to the control portion and move therewith. FIG. 9 may also be interpreted as showing the second end 436 attached to the control portion 466. The midportion of the flexible element extends downwardly from the second end, under and around the lower pulley 470 on the foot support link 418, then upwardly and around the control pulley 442 on the control portion 466 of the guide link 410, then downwardly to the vertical drive assembly. The operation is similar to the device 300 except that the block-and-tackle arrangement of the lower pulley allows the coupling point to the foot support link to be moved forwardly and still obtain the same amount of motion. Alternatively, the coupling point may be moved to a different position and more movement of flexible element is required. The control distance to the control pulley may be different than for versions without the pulley 470. The block-and-tackle arrangement may be used with any embodiment of the present invention, and all features of all embodiments may be interchanged as necessary to provide a design that meets performance requirements.

The elliptical exercise devices of the present invention may be referred to as suspension elliptical exercise devices since the foot supports are suspended by the flexible elements rather than being supported by rollers on tracks.

Further alternatives, which do not depart from the scope or teaching of the present invention, will be clear to those of skill in the art. The drawings provided herewith may be to scale, or approximately to scale for some embodiments and not to scale for other embodiments. It is the following claims, including all equivalents, which define the scope of the present invention.

The invention claimed is:

1. An exercise device comprising:

a frame configured to be supported on a horizontal surface, the frame having an upper portion with a first pivot axis defined thereon;

a first and a second guide link each having a first and a second attachment point defined thereon, each guide link being pivotally attached, through its first attachment point, to the frame at the first pivot axis thereof, each of the guide links having a guide length defined between the respective first and second attachment points;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion, each of the foot support links having a coupling point defined thereon;

a first and a second control pulley each pivotally connected to a respective one of the guide links at a distance offset from the first pivot axis such that the control pulleys each move in an arc as the corresponding guide link pivots, the distance defined as a control distance, the control distance being less than or equal to 50% of the guide length;

a vertical drive assembly supported on the frame; and a first and a second flexible element each coupling the vertical drive assembly to the coupling point of a respective one of the foot support links, each flexible element having a midportion extending from the coupling point of the respective foot support link to and about a respective one of the control pulleys;

wherein the vertical drive assembly is operable via the flexible elements to move the foot receiving areas of the foot support links in a path of travel having a vertical component of motion.

2. The exercise device according to claim 1, wherein each guide link has a forwardly extending control portion, each control pulley supported on the respective control portion.

3. The exercise device according to claim 1, wherein the flexible element extends directly from the control pulley to an end of the flexible element connected to the vertical drive assembly.

4. The exercise device according to claim 1, wherein each control pulley is disposed below the first pivot axis and forward of the first pivot axis when the respective guide link is disposed generally vertically.

5. The exercise device according to claim 1, further comprising a first and a second frame-mounted pulley disposed on the frame, each flexible element extending about a respective one of the frame-mounted pulleys between the respective control pulley and vertical drive assembly.

6. The exercise device according to claim 5, wherein the frame-mounted pulleys are disposed lower than the control pulleys.

7. The exercise device according to claim 6, each frame-mounted pulley is disposed generally directly below the corresponding control pulley when the corresponding guide link is disposed generally vertically.

8. The exercise device according to claim 1, further comprising:

a horizontal drive assembly;

a first and a second horizontal drive link each having a first end coupled to the horizontal drive assembly and a second end connected to the corresponding guide link such that the horizontal drive assembly causes the guide links to pivot about the first pivot axis and to thereby cause the foot receiving areas to move in the path of travel having the horizontal component of motion.

9. The exercise device according to claim 8, wherein the horizontal drive links each extend generally rearwardly from the horizontal drive assembly to the respective guide link.

10. The exercise device according to claim 8, wherein each guide link has a forwardly extending connection portion, each of the horizontal drive links extending generally vertically from the horizontal drive assembly to a respective one of the connection portions.

11. The exercise device according to claim 10, wherein each control pulley is supported on the connection portion of the corresponding guide link at an axis coaxial with an attachment of the respective horizontal drive link.

12. The exercise device according to claim 8, further comprising a crank system defining both the horizontal drive assembly and the vertical drive assembly, the crank system having a crank axis and a pair of crank connections offset from and rotatable about the crank axis, each of the flexible elements having an end connected to one of the crank connections of the crank system such that the ends each travel in a circular path, the first ends of the horizontal drive links being connected to the crank system such that rotation of the crank system causes the foot receiving areas to move both in the path of travel having the horizontal component of motion and in the path of travel having the vertical component of motion, the horizontal component of motion and the vertical component of motion for each foot receiving area being generally out of phase such that the foot receiving areas move in a generally elliptical path.

13. The exercise device according to claim 12, wherein the horizontal drive links are connected to the crank system at locations that are rotationally offset from the crank connections.

14. The exercise device according to claim 1, wherein the flexible elements each have second ends directly connected to the coupling point of the respective foot support link.

15. The exercise device according to claim 1, further comprising a lower pulley connected to each of the foot support links and defining the coupling points of respective foot support links, each of the flexible elements having a first end, an opposed second end, and a midportion between the first and second ends, the second end of each of the flexible elements being connected to the upper portion of the frame or to the guide link, the midportion of each of the flexible elements extending downwardly from the second end, about the respective lower pulley, and upwardly and about the respective control pulley.

16. The exercise device according to claim 15, wherein each foot support link has a forward end that is pivotally connected to the second attachment point of the respective guide link, a rearward end defining the foot receiving area, and a midportion, the lower pulleys each being connected to the midportion of the respective foot support link.

17. The exercise device according to claim 1, wherein the vertical drive assembly comprises a crank system, the crank system having a crank axis and a pair of crank connections offset from and rotatable about the crank axis, the flexible elements each having a first end connected to one of the crank connections of the crank system such that the first ends travel in a circular path.

18. The exercise device according to claim 1, wherein the control distance is in the range of 5% to 25% of the guide length.

19. The exercise device according to claim 1, further comprising a first and a second guide pulley attached to the guide link, the midportion of each flexible element engaging a respective one of the guide pulleys between the respective coupling point and control pulley.

20. The exercise device according to claim 1, wherein a range of the vertical component of motion and/or the horizontal component of motion are adjustable.

21. The exercise device according to claim 1, wherein each guide link has a forwardly extending control portion, each control pulley supported on the respective control portion, each control portion being adjustable with respect to the respective guide link to alter the path of travel.

22. The exercise device according to claim 1, wherein each flexible element is a cable, a belt or a chain.

23. The exercise device according to claim 1, wherein each guide link further includes a hand grip portion extending upwardly from the first attachment point.

24. An exercise device comprising:

a frame configured to be supported on a horizontal surface, the frame having an upper portion with a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion, each of the foot support links having a coupling point defined thereon;

a first and a second control pulley each pivotally connected to a respective one of the guide links at a distance offset from the first pivot axis such that the control pulleys each move in an arc as the corresponding guide link pivots;

a vertical drive assembly supported on the frame; and a first and a second flexible element each coupling the vertical drive assembly to the coupling point of a respective one of the foot support links, each flexible element having a midportion extending directly from the coupling point of the respective foot support link to and about a respective one of the control pulleys;

wherein the vertical drive assembly is operable via the flexible elements to move the foot receiving areas of the foot support links in a path of travel having a vertical component of motion.

25. An exercise device comprising:

a frame configured to be supported on a horizontal surface, the frame having an upper portion with a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion, each of the foot support links having a coupling point defined thereon;

a first and a second control pulley each pivotally connected to a respective one of the guide links at a distance offset from the first pivot axis such that the control pulleys each move in an arc as the corresponding guide link pivots;

a vertical drive assembly supported on the frame; and a first and a second flexible element each coupling the vertical drive assembly to the coupling point of a respective one of the foot support links, each flexible element having a midportion extending from the coupling point of the respective foot support link to and about a respective one of the control pulleys, a control portion of each flexible element being defined from the coupling point to the corresponding control pulley, each control pulley being positioned relative to the first attachment point of the corresponding guide link such that as the second attachment portion of the guide links swing forwardly, the corresponding control portion of the respective flexible element is shortened;

wherein the vertical drive assembly is operable via the flexible elements to move the foot receiving areas of the foot support links in a path of travel having a vertical component of motion.

* * * * *